United States Patent [19]

Bliemeister

[11] Patent Number: 4,759,271

[45] Date of Patent: Jul. 26, 1988

[54] WIND DEFLECTING VENTILATOR

[76] Inventor: Louis P. Bliemeister, 774 Hendrickson Rd., Sequim, Wash. 98382

[21] Appl. No.: 132,177

[22] Filed: Dec. 14, 1987

[51] Int. Cl.[4] ..... B63B 19/06

[52] U.S. Cl. ..... 98/37; 114/211

[58] Field of Search ..... 98/2.14, 13, 37, 65, 98/64; 114/211

[56] References Cited

U.S. PATENT DOCUMENTS 1,737,610 12/1929 Horton ..... 98/37
3,757,664 9/1973 Jalbert ..... 98/37
4,706,593 11/1987 Vail, Jr. ..... 98/37 X

FOREIGN PATENT DOCUMENTS 2455 of 1872 United Kingdom ..... 98/64

*Primary Examiner*—Harold Joyce
*Attorney, Agent, or Firm*—William I. Beach

[57] ABSTRACT

The wind deflecting ventilator comprises an open frame attached to a fabric scoop-like receptacle for turning the direction of moving air down an opening hatch on a small boat. The sides of the frame are connected at the corners by flexible couplings. Secured to the upper side of the frame is an enlongated cord having divided end lengths fastened to a lower side adjacent to spaced couplings. Included is a pair of short lengths of cords attached to the divided cords having loose ends for fastening the frame and receptacle to the sides of an opened hatch.

12 Claims, 2 Drawing Sheets

WIND DEFLECTING VENTILATOR

BACKGROUND OF THE INVENTION

1. Field of the Invention

The present invention relates to small boat ventilators and more particularly to cloth and plastic frame ventilators that are readily foldible into a small package for storage.

2. Description of the Prior Art

A novelty search of ventilating devices for hatch openings on small sail and powered boats are generally complicated in design and presents considerable problems relative to installation, obstruction features and costs. Most are constructed of metal and are of the cowl type bolted to the deck or fastened in some manner to the hatch.

A cloth type of ventilator called "Windscoop" is disclosed in E and B Marine Supply, Inc., Catalog, pages 118 and 119. The windscoop is a sail like form which has two batten sewn in place. It is hung from a halyard, boom or roller furling jet-sheet. In so far as a small sail boat is concerned the means for hanging the windscoop appears to form an obstruction in the management of sails and lines. In a powered boat there may not be overhead means for supporting the windscoop. Further, this type of ventilator does not protect an open hatch from rainfall.

Another cloth ventilator is disclosed in U.S. Pat. No. 3,757,664 that is also suspended from an overhead tie which provides similar problems suggested for the windscoop. This ventilator is configured on an X-shaped frame to deflect wind coming from any direction down into an open hatch. The ventilator is formed into a top section for receiving a gust of wind and bottom section suggested as a difusing chamber. The bottom section has a rigid frame for fitting beneath the hatch opening. It is obvious that this device is complicated, expensive and would allow rain to drip down into the hatch.

U.S. Pat. No. 1,737,610 discloses a folding windscoop comprising a plurality of arcuate shaped metal bands pivoted from a common pivot on each side of the hatch. It is substantially more complex mechanically, more expensive to construct and can only be used on a round hatch.

SUMMARY OF THE INVENTION

In carrying out the principles of the present invention in accordance with a preferred embodiment thereof a portable ventilator has a foldable quadrilateral frame. The frame has an opening for the passage of movable air therethrough and is mounted on a boat deck adjacent to an open hatch. There are four hinge-like couplings connecting the sides at the corners of the frame. Included is a first ligature that has a middle portion of its length fastened to an upper side of the frame intermediate of a pair of spaced corners. Likewise the divided portions of the ligature's length are fastened to a lower side adjacent to spaced corners thereon. A flexible receptacle has an opening corresponding to the frame opening. The top, bottom and sides edges of the receptacle are connected to notched out portions at the corners. The notches separates the edges into flap portions which are wrapped around the frame sides and secured thereon. Connected to the edges is a pair of spaced arcuate side panels and a covering panel having side edges fastened to the arcuate side edges of the side panels. A second pair of ligatures have inner ends fastened separately to one of each of the first ligatures divided lengths and the outer free end extending loosely for connecting means.

Fastening means is provided by the connecting means whereby the frame is secured to the sides of the open hatch so that the wind received in the receptacle is deflected down the hatchway. The portable ventilator can also be stored by unfastening the connecting means and with folding means in combination with the hinge-like couplings the sides of the frame are collapsed in two folding operation whereupon the opposite pairs of the sides are folded together in a stack and wrapped in the receptacle.

DETAILED DESCRIPTION OF THE PRESENT INVENTION

Figure 2:
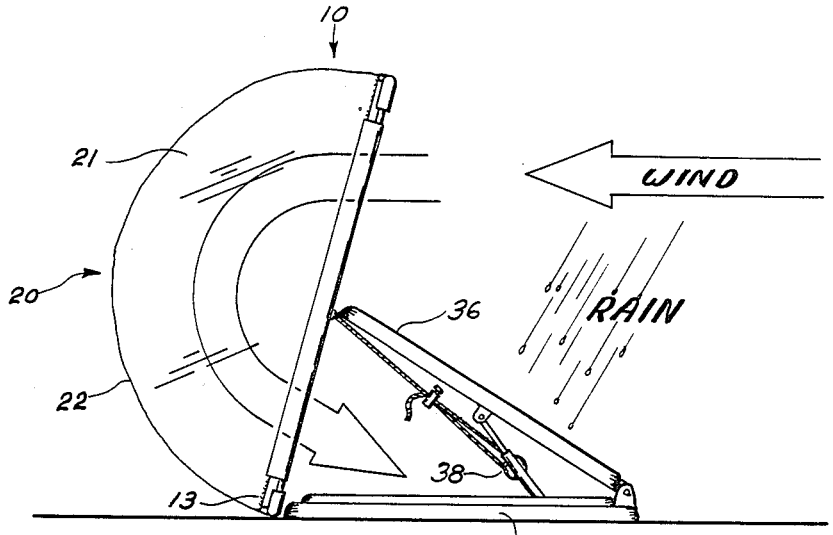
FIG. 2 is side elevated view of the portable ventilators of the present invention mounted on the deck of a boat in front of and secured to the sides of an open hatch.
Figure 3:
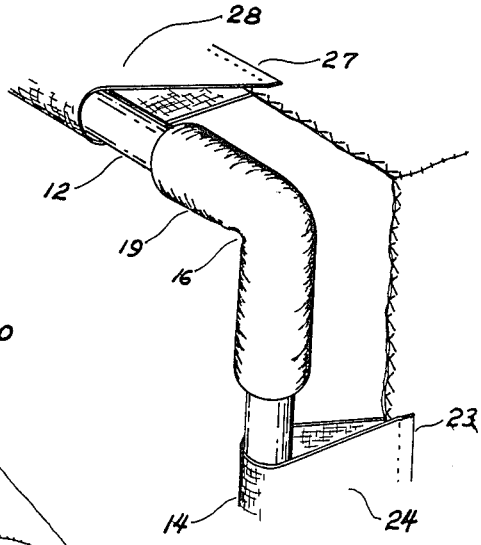
FIG. 3 is a prospective partial end view of a front corner of the open ventilator frame and receptacle showing a flexible coupling.
Figure 1:
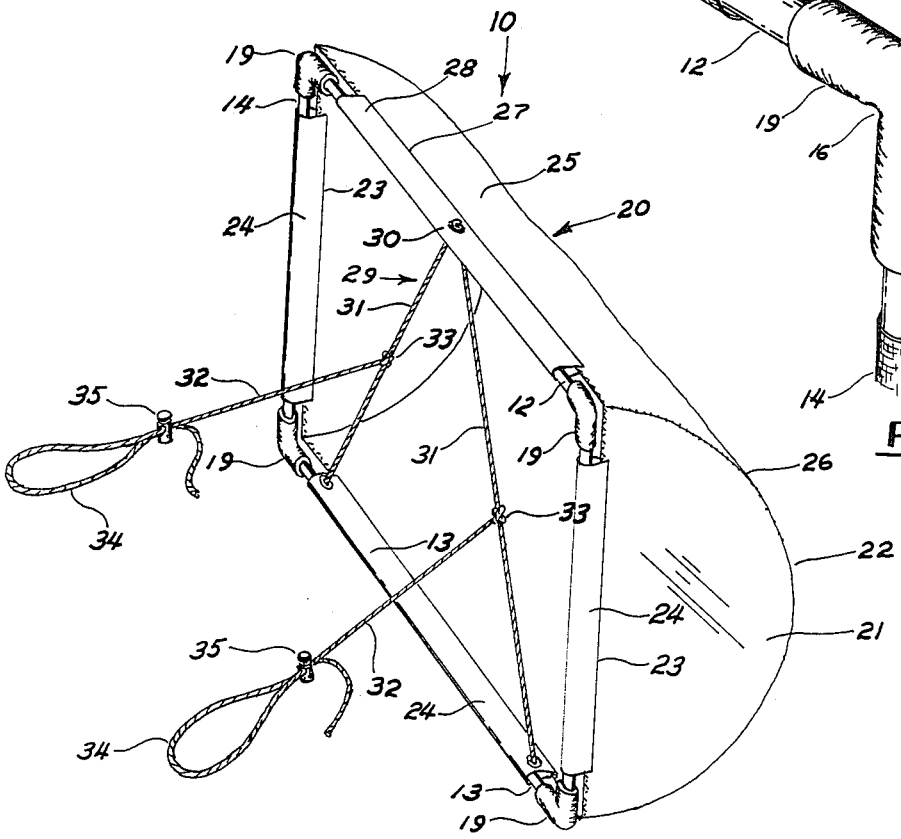
FIG. 1 is a perspective front elevated view of an embodiment of the present invention.

Referring to FIGS. 1–3 it can be seen that a foldable ventilator 10 consists of an open frame attached to a scoop-like receptacle. The sides of the frame are connected together by flexible couplings. Secured to the upper side of the frame is an elongated cord which has two divided lengths fastened to a lower side adjacent to the pair of couplings at the opposite corners of the lower side. There are a pair of short cords, one of each being fastened to the divided length of the cord and the loose ends formed in a loop for fastening the ventilator to the sides of an open hatch.

Figure 4:
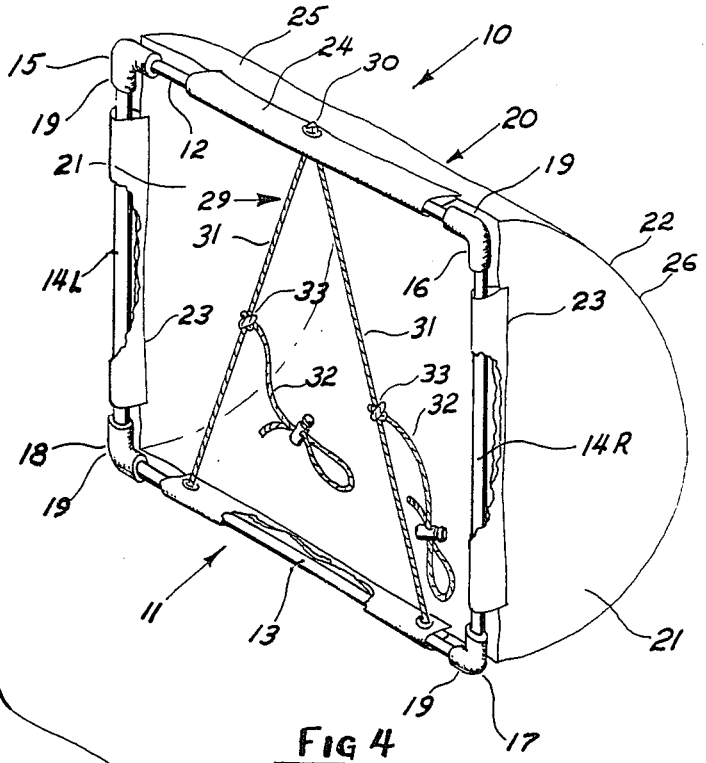
FIG. 4 is another view of FIG. 1 showing sectional portions of the ventilator frame.
Figure 5:
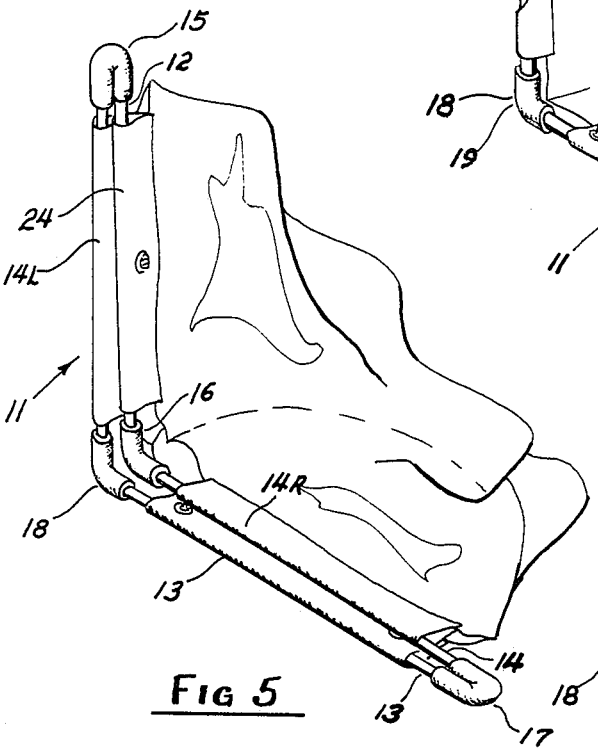
FIG. 5 is a front elevated view of FIG. 1 showing the frame and receptacle folded diagonally in half.
Figure 6:
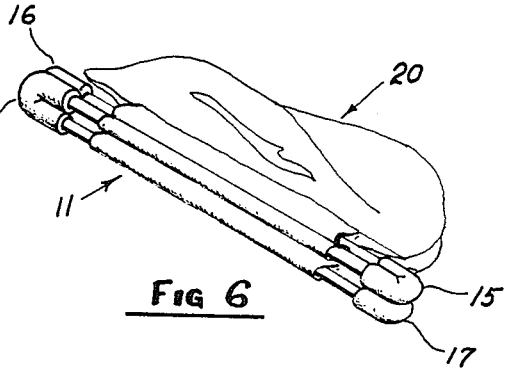
FIG. 6 is a front view of FIG. 6 showing the frame and receptacle completely folded.
Figure 7:
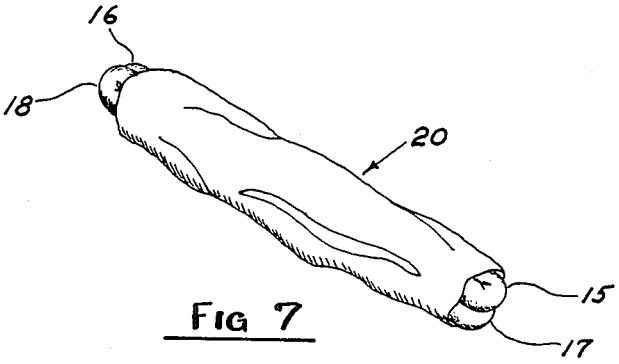
FIG. 7 is a front view of FIG. 6 wrapped up in the receptacle.

The ventilator 10 includes a foldable frame 11 assembled with four plastic side members forming an upper side 12, a lower side 13 and a pair opposite sides 14L and 14R. At the corners of 15, 16, 17 and 18 respectively of adjoining sides is a coupling 19. Coupling 19 is a small flexible tube preferably formed of a soft rubber like material. The flexible tube is slipped over the ends of the four side members sufficiently to provide a space between the ends so as to allow the sides of the frame to fold together in a pile of stacked sides. Attached to the sides of frame 11 is a receptacle 20. The receptacle is formed of a durable, water repellent material formed in the shape of a flexible scoop comprising a pair of spaced side panels 21 having an arcuate shaped back edge 22 and a front vertical edge 23. The junction of the vertical edge 23 and arcuate edge 22 is notched at both ends to form a flap 24 which is wrapped around the spaced sides 14 of frame 11 and stitch to the arcuate side panels 21. A rectangular panel 25 is stretched between the side panels and has the longer side edges 26 stitched to the arcuate back edges 22 of side panels 21. Similarly to the arcuate side panels, the front horizontal edges of panel 25 are notched at the opposite ends to provide flaps 28 which is wrapped around the upper and lower sides 12 and 13 respectively and stitched to rectangular panel 25. An elongated cord 29 has a middle portion 30 of its length 29 fastened to the upper side 12 of frame 11 intermediate of corners 15 and 16, FIG. 4. The left over lengths 31 are fastened at their ends to lower side 13 adjacent to corners 17 and 18, FIG. 4. A pair of shorter cords 32 have inner ends 33 fastened to the left over lengths 31 of elongated cord 29 and outer ends 34 looped and held together by a stop device 35. The looped ends 34 are adapted to fasten ventilator 10 to the sides of an open hatch 36. One of the novel features of the present invention is that the ventilator 10 is readily installed in front of the open hatch in a matter of a few seconds with the lower side 13 of the frame adjacent to the hatch coaming 37. Then the looped ends 34 of cords are hung over the usual knob and other projections present on the hatch closing arms 38 and the like. The length of cords 32 can be adjusted to place the ventilator at an optimum angle such that the upper side 12 of frame 11 is leaning over the front end of hatch as may be seen in FIG. 2. This feature tends to prevent rainfall or most of the water from entering the hatchway. In this position the curvature of the receptacal receives and directs wind passing over the hatch down into the hatchway. Another unique feature of the present invention is that when not needed the ventilator 10 assembly can be readily unfastened from the hatch and folded into a compart package for storage. This is accomplished by folding the corner 16 and adjoining sides 12 and 14R diagonally and downwardly to the third corner 18 whereby sides 12 and 14L and sides 13 and 14R are placed together. Then the upstanding corners 15 and adjoining sides 13 and 14R are placed together. Then the upstanding corners 15 and adjoining sides 12 and 14L are folded downwardly to corner 17 and the sides 12, 13, 14L and 14R are stacked together as shown in FIG. 5. FIG. 6 shows the sides 12, 13, 14L and 14R rolled up in receptacle 20 for storage.

From the aforegoing description and illustration of the present invention it is obviously an improvement over the above referenced prior art and provides important advantages.

The above description is to be clearly understood to be given by illustration and example only, the spirit and scope of the present invention being limited solely by the appended claims.

I claim:

1. A portable ventilator adapted to deflect a stream of air down a boat hatchway, which comprises:

a foldable upstanding quadrilateral frame having an opening for the passage of wind therethrough adapted to rest on a boat deck adjacent to a partially opened hatch, at least four hinge-like couplings connecting the sides at corners of the four sided frame, a first ligature having a middle portion of a length fastened to an upper side intermediate of the spaced corners thereon and the divided portions of the length being fastened to a lower side adjacent to the spaced corners thereon, a flexible receptacle having an opening corresponding to said frame opening consisting of a top, bottom and side edges connected to notched out portions at said corners of the receptacle, the notches providing separated flaps adapted to wrap around and be secured to said frame sides, said receptacle further including a pair of spaced arcuate side panels and a covering panel having side edges connecting to the arcuate side edges of the side panels, a pair of second ligatures having inner ends fastened separately to one of each of the divided lengths and the outer free ends being loosely extended for connecting means, means in combination with the connecting means adapted to fasten said frame and receptacle to the sides of the partially opened hatch for receiving and deflecting the wind down the hatchway, and means in cooperation with the upstanding frame and hinge-like couplings adapted to fold said frame consists of two of said sides and connecting coupling being folded diagonally to the opposite coupling and connecting sides and the remaining upstanding coupling and sides being folded downwardly to the opposite of said sides and coupling.

2. A portable ventilator as described in claim 1, wherein:

said sides of said frame are straight lengths of tubing.

3. A portable ventilator as described in claim 1, wherein:

said hinge-like couplings are small lengths of flexible tubing mounted over the ends of the tubes of said frame.

4. A portable ventilator as described in claim 1, wherein:

the second and said first ligatures are woven lengths of cord.

5. A portable ventilator as described in claim 1, wherein:

said receptacle is formed of a fabric material having the side panels stitched to the covering panel

6. A portable ventilator as described in claim 1, whereby:

means in combination with an upstanding frame and hinge-like couplings adapted to fold said frame consists of an upper corner and connecting sides being bent diagonally to a lower corner and connecting sides resulting in to an L-shaped form thereby placing an upper horizontal side along an upstanding vertical side and the other vertical side along a lower horizontal side whereupon the upstanding vertical side and upper horizontal side and then being folded downwardly to the lower horizontal side and the other vertical side.

7. A portable ventilator adapted to deflect a stream of air down a boat hatchway, which comprises:

a collapsible quadrilateral frame having an opening for the passage of wind therethrough including a tubular top, bottom and sides, the frame being adapted to rest on a boat deck adjacent to an open hatch, at least four small lengths of flexible elbows mounted over the ends of the tubular sides of said frame defined successively as the first, second, third and fourth corners, a first woven cord having a center of a length connected to said frame top side intermediate of said elbows thereon and the separated cord lengths being fastened to said bottom side adjacent to said elbows thereon, a fabric-like enclosure having an opening similar to said frame opening consisting of a top, bottom, and side edges connected together around notched out corners of the enclosure, providing separated flap portions adapted to wrap around and be stitched together around said frame, said enclosure further including a pair of spaced arcuate shaped side panels and a rectangular covering panel having side edges stitched to the edges of the side panels, a pair of second woven cords having inner ends tied separately to one of each of the separated cord lengths and the outer free ends being extended loosely for tie members, means in combination with the tie members adapted to fasten said frame to the open door hinges for receiving and deflecting wind down the hatch from said enclosure, and means in combination with the flexible elbows arranged to bend one of an upper of said corners of said frame including adjacent sides downwardly together with a diagonal corner and adjacent sides and then bend the opposite pair of corners together so as to place said sides in stacked position for wrapping in said enclosure for storage.

8. A portable ventilator as described in claim 7, wherein:

said sides of said frame are substantially lengths of hard plastic tubes.

9. A portable ventilator as described in claim 7, wherein:

said flexible elbow is a rubber-like sleeve adapted to bend readily except in a plane extending through and parallel to the opening in said frame.

10. A portable ventilator as described in claim 7, wherein:

said tie members further include a small cylindrical plastic device having a hole through the side thereof through which the end of said tie member is threaded twice for a stop member adapted to secure said frame to the sides of said hatch.

11. A portable ventilator as described in claim 7, wherein:

said enclosure is similar to a scoop in shape and has an inner curvature sufficient to change the direction of said wind passing over the back of said open hatch around and down into said hatch.

12. A portable ventilator as described in claim 7, wherein:

the means in combination with the upstanding frame and said flexible elbows for folding said sides of said frame comprises an upper of the second of said corners and adjacent sides being folded diagonally to a lower of the fourth corner and adjacent sides of an L-shaped form thereby placing an upper horizontal side along an upstanding vertical side and the other vertical side along a lower horizontal side an then the upstanding vertical side together with the upper horizontal side and the first corner being folded downwardly to the lower horizontal side and the third corner.

* * * * *